United States Patent [19]

Wilkerson

[11] Patent Number: 4,538,806

[45] Date of Patent: Sep. 3, 1985

[54] EXERCISER DUMBBELLS

[75] Inventor: C. William Wilkerson, Raleigh, N.C.

[73] Assignee: Campbell Soup Company, Camden, N.J.

[21] Appl. No.: 537,271

[22] Filed: Sep. 29, 1983

[51] Int. Cl.[3] ..... A63B 11/00

[52] U.S. Cl. ..... 272/122

[58] Field of Search ..... 272/96, 119, 122, 123, 272/124

[56] References Cited

U.S. PATENT DOCUMENTS

| | | | |
|---|---|---|---|
| 808,706 | 1/1906 | Saint Charles Villedrovin | 272/122 |
| 984,721 | 2/1911 | Titus | 272/122 |
| 1,019,584 | 3/1912 | Balston | 272/122 |
| 3,334,899 | 8/1967 | Bosko et al. | 272/84 |

*Primary Examiner*—Richard J. Apley
*Assistant Examiner*—James Prizant
*Attorney, Agent, or Firm*—Albert L. Free

[57] ABSTRACT

An exercise dumbbell of the type comprising a central grip portion and a pair of weighted bells on each end of the grip portion, wherein each of the bells comprises a soft, pliable outer covering filled with a yieldable mass of weighting material, and wherein the dumbbell comprises an axial support means extending axially of the grip. Preferably the support means is in the form of a rod, solid or hollow, and the end bells, as well as the supporting rod if hollow, are preferably filled with a yieldable mass of weighting material such as small balls or shot, a liquid or a gelatin, or a heavy liquid or gelatin with or without metal particles or pieces dispersed through it.

7 Claims, 2 Drawing Figures

EXERCISER DUMBBELLS

BACKGROUND OF THE INVENTION

Dumbbells are commonly used for exercising the body, particularly the arms, and comprise a grip portion of relatively smaller diameter and a pair of bells of larger diameter, one at each end of the grip portion.

The dumbbells are commonly made of an integral piece of cast metal. Such dumbbells, being hard and unyielding, are more likely to mar or damage floors or furnishings which they happen to strike, are noisy when struck together or against other objects, can cause serious injury if they strike the body of a person, and often are abrasive or uncomfortable to handle or carry. It is known, as disclosed in U.S. Pat. No. 3,482,834 of James, Jr., issued Dec. 9, 1969, to make a dumbbell of a hard material, such as cement, covered with a yieldable plastic having wear-resistant qualities. While such a dumbbell provides some protection against marring and against unnecessary noise and injury to persons, and provides an improved "feel", the interior weighting material (e.g. cement) is dense and hard, and hence imparts to the assembly a substantial unyielding character when dropped, for example.

U.S. Pat. No. 3,334,899 of J. M. Bosko et al, issued Aug. 8, 1967, shows an integral hollow self-supporting dumbbell casing filled with fluid (FIG. 5), and also shows a dumbbell in which hollow fluid-containing end spheres of rubber or the like are screw-fitted to an intervening handle so that either the handle length or the bell can be changed. In the first form of this device mentioned above, it is clear that the hard rubber is sufficiently strong, dense and inflexible to maintain structural integrity of the dumbbell even though it is filled with weighting material, and hence it cannot be yielding in nature; the principal purpose of the device is to enable filling of the dumbbell to different levels, thereby to vary its total weight for different exercise purposes. The same may be said of the embodiment of the Bosko et al FIG. 6, in which the rubber bells are of such strength and rigidity as to enable them, for example, to be screwed on to the mating threads of a connecting rod. Accordingly, this dumbbell is also not as soft, pliable or yieldable as would be desired.

The present invention provides a new and useful form of dumbbell which is exceptionally soft and pleasing to the touch, is highly yielding so as not to mar furnishings and the like, is simple to make, and yet maintains its configurational integrity, thereby overcoming one or more of the above-mentioned drawbacks of previously-known dumbbells.

SUMMARY OF THE INVENTION

These and other objects of the invention are achieved by the provision of a dumbbell in which each of the bells comprises an integral, soft, pliable covering containing a yieldable mass of weighting material. In a preferred form it also comprises one or more of the following additional features. It preferably comprises an axial support means extending axially of the grip, to lend rigidity to the dumbbell, this support preferably also being covered with the soft pliable covering material. The support means preferably extends to the opposed interior end walls of the bells, where it may terminate or where it may be held in appropriate holding means, e.g. within a cylindrical wall or within a cylindrical depression in the end surface of the bell; or, it may be supported in a hole extending through the end wall of the bell. The support means may be solid or hollow, but when it is hollow it is preferred to fill it with the same weighting material as is used in the end bells.

The yieldable weighting material in the bells may take any of a variety of forms, for example metal shot, liquid, gel, a liquid or a gel containing shot or metal filings, or preferably, for the sake of simplicity, metal shot with only air between the shot.

The covering is preferably a plastic material, for example non-porous vinyl or urethane; it is preferably between about $\frac{1}{8}''$ and $\frac{1}{4}''$ in thickness and integral over the entire exterior of the dumbbell.

BRIEF DESCRIPTION OF FIGURES

These and other objects and features of the invention will be more readily understood from a consideration of the following detailed description, taken in connection with the appended drawings.

DETAILED DESCRIPTION OF PREFERRED EMBODIMENTS

Figure 1:
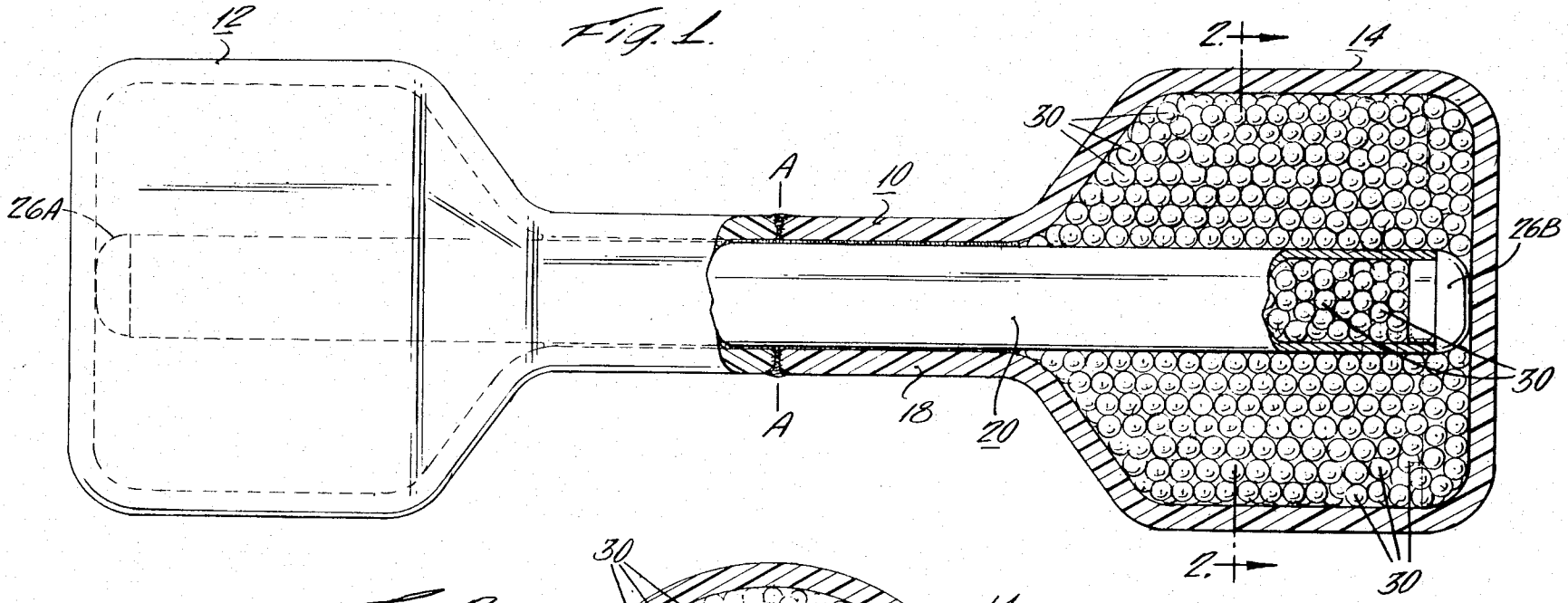
FIG. 1 is a side elevational view, with parts broken away, of a dumbbell constructed in accordance with a preferred embodiment of the invention.
Figure 2:
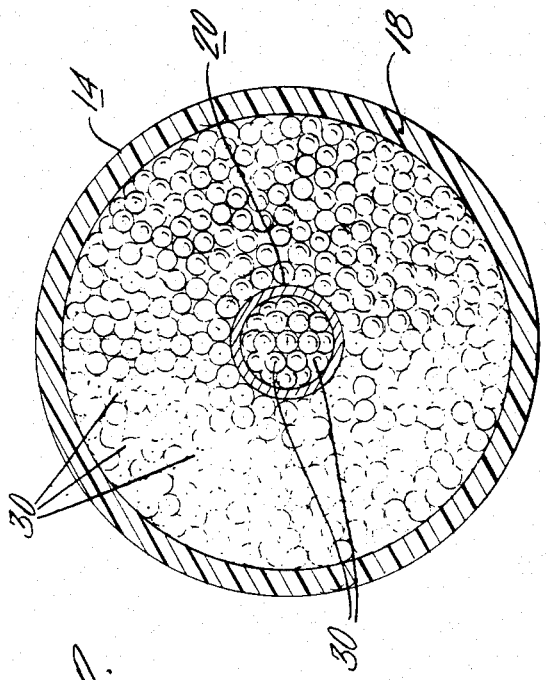
FIG. 2 is a section taken along lines 2—2 of FIG. 1.

Referring now to the particular embodiment of the invention shown by way of example only in the drawings, the dumbbell shown may typically be about $10\frac{1}{2}''$ long overall and about $3\frac{1}{2}''$ in diameter at the end bells, to provide a dumbbell of about 6 pounds weight when constructed as now to be described.

The dumbbell comprises a cylindrical grip portion 10 of relatively smaller diameter and a pair of approximately cylindrical bells 12 and 14 of greater diameter than grip portion 10. The exterior of the entire dumbbell is covered by an integral thick skin or covering 18 of a soft, pliable material, for example vinyl or urethane; a typical thickness for the covering is from about $\frac{1}{8}''$ to about $\frac{1}{4}''$.

Axially disposed inside the covering is a support means 20, in this case in the form of a hollow metal tube, although in other embodiments it may be a solid metal rod. The tube fits closely inside of, and is preferably bonded to, the covering 18 in the grip portion 10, and preferably extends substantially to the two opposed interior end walls of the bells; while not so shown in this example, in some cases the ends of the support means 20 may be held in position with respect to the ends walls of the bells by means of a cylinder formed on the interior of each end wall and into which the ends of the tube or rod fits securely.

In this example, the bells 12 and 14 as well as the hollow tube 20 are filled with steel balls such as 30, each having a diameter of from about 0.050" to about 0.200".

In this example the interstices between the balls are filled with air, although in other examples they may be filled with a flowable material such as a wax, a glycol, or a liquid thickened with a food thickener, as examples.

The plastic exterior covering of the dumbbell of FIG. 1 may be made by any of a variety of known molding techniques, and in this case it is assumed it is made by so-called rotational molding; in other cases it may be made by injection molding, in which case it is easier to provide the above-mentioned centering clinder on the interior end walls of the dumbbell to aid in holding the ends of the support rod.

In this example the outer covering of the dumbbell is made in two parts, one extending to the left of the vertical line A—A in FIG. 1 and the other extending to the right of the line A—A. After the two halves have thus been appropriately formed, as by rotational molding as mentioned above, a measured quantity of the metal shot is poured into each of the bells through the openings in the grip portions of the two halves. The mating surfaces of the two halves of the covering extending along the line A—A are coated with a suitable adhesive, which may if desired be a heat-responsive adhesive, and at least the portion of the tube 20 which is to be secured to the grip portion 10 of the dumbbell is similarly coated with adhesive. The tube 20 may then be easily worked through the center of the grip portion into one of the bells until it reaches the interior of the end wall of the bell into which it is being inserted; then the bell with the rod in it may be inverted and the free end of the tube inserted downwardly into the other ball-containing half of the dumbbell skin, until the other end of the support tube is positioned near the interior wall of the other bell and the two halves of the outer skin are against each other along the line A—A. Since the appropriate number of balls has been previously measured into each end bell, the parts will fit together as above-described, with both end bells completely filled.

In order to protect the end walls of the bell, it is preferable to utilize a pair of soft plastic end plugs 26*a* and 26*b*, which may be fitted into, and cemented to, the opposite ends of tube 20 as shown. In order to increase the weight of the assembly, the interior tube 20 is preferably filled with the same type of metal balls 30 as is in the bells outside of the tube, prior to application and cementing of the end caps 26*a* and 26*b*.

In addition to rotational molding and injection molding, blow molding may be employed in making a dumbbell according to the present invention. While simple pressure adhesives may be used for the bonding described above, as mentioned it is also possible to use heat-activated adhesives, in which case when the assembly is completed as described above the entire assembly is subjected to heat sufficient to activate the adhesive.

If the dumbbell is fabricated as a single entity, rather than in two halves, it may be filled by providing a suitable fill opening in one or both ends thereof, which opening or openings are plugged up or sealed after the assembly is complete; in such case, the central support rod will normally be introduced and positioned by way of at least one axial hole extending through the outer covering of the dumbbell, the hole being provided with a suitable bushing and locking nut arrangement (not shown). While it is preferred that the central supporting rod extend as described and shown, in some instances where the weighting material is sufficiently dense, i.e. composed of relatively fine particles, and is tightly packed into the end bells, it is sufficient that this integral supporting rod extend only as far as the opposite ends of the grip portion 10, rather than extending all the way to the interior end walls of the bells.

It will be seen that the dumbbell of the invention is extremely simple in form, in components used and in mode of assembly, yet is very yielding upon impact with another body, and has a soft, pliable exterior and excellent feel.

While the invention has been described with particular reference to specific embodiments in the interest of complete definiteness, it will be understood that it may be embodied in a variety of forms diverse from those specifically shown and described without departing from the spirit and scope of the invention as defined by the appended claims.

What is claimed is:

1. An exercise dumbbell, comprising a grip portion and a pair of bells one at each end of the grip portion, wherein:

each of said bells and an adjacent portion of said grip portion consists of a soft pliable outer covering, said adjacent portions being in abutting engagement and forming the entire grip portion, whereby said dumbbell is substantially completely covered by said pliable outer covering, each of said bells having an imperforate outer surface and being filled with a dense yieldable mass of particulate weighting material, said covering and said yieldable mass being insufficently rigid to maintain the configurational integrity of said dumbbell, and said dumbbell comprises a rigid axial support means covered by said soft pliable outer covering and extending axially through said grip portion substantially to the interior end walls of said bells and being free of attachment to said end walls.

2. The dumbbell of claim 1, wherein said support means is hollow and closed at each end and contains a yieldable mass of weighting material.

3. The dumbbell of claim 1, where said support means is a solid rod.

4. The dumbbell of claim 1, wherein said weighting material comprises a plurality of metal balls.

5. The dumbbell of claim 4, wherein said yieldable material comprises a gel in the interstices between said balls.

6. The apparatus of claim 1, wherein said is of a plastic material from about $\frac{1}{8}''$ to about $\frac{1}{4}''$ in thickness.

7. The dumbbell of claim 6, wherein the plastic material is selected from the group consisting of vinyls and urethanes.

* * * * *